US006349439B1

(12) United States Patent
Cook et al.

(10) Patent No.: US 6,349,439 B1
(45) Date of Patent: Feb. 26, 2002

(54) ALTERNATING PAD

(75) Inventors: Stephen John Cook, Reading; Christopher John Daughtery, Hertfordshire, both of (GB)

(73) Assignee: Huntleigh Technology, PLC, Bedfordshire (GB)

( * ) Notice: Subject to any disclaimer, the term of this patent is extended or adjusted under 35 U.S.C. 154(b) by 0 days.

(21) Appl. No.: 09/117,694

(22) PCT Filed: Dec. 3, 1997

(86) PCT No.: PCT/GB97/03338

§ 371 Date: May 3, 1999

§ 102(e) Date: May 3, 1999

(87) PCT Pub. No.: WO98/24345

PCT Pub. Date: Jun. 11, 1998

(30) Foreign Application Priority Data

Dec. 4, 1996 (GB) ..... 9625220

(51) Int. Cl.[7] ..... A47C 27/08
(52) U.S. Cl. ..... 5/713; 5/710; 5/706
(58) Field of Search ..... 5/615, 691, 706, 5/710, 713; 141/114

(56) References Cited

U.S. PATENT DOCUMENTS

| | | | | | |
|---|---|---|---|---|---|
| 4,042,988 | A | * | 8/1977 | Holliday | 5/710 |
| 4,336,621 | A | * | 6/1982 | Schwartz et al. | 5/691 X |
| 4,679,264 | A | * | 7/1987 | Mollura | 5/710 |
| 4,807,313 | A | * | 2/1989 | Ryder et al. | 5/713 X |
| 5,394,577 | A | * | 3/1995 | James et al. | 5/713 |
| 5,421,044 | A | * | 6/1995 | Steensen | 5/710 |
| 5,634,224 | A | * | 6/1997 | Gates | 5/710 X |
| 5,701,622 | A | * | 12/1997 | Biggie et al. | 5/713 |
| 5,745,942 | A | * | 5/1998 | Wilkerson | 5/713 X |
| 5,806,572 | A | * | 9/1998 | Voller | 141/114 X |

FOREIGN PATENT DOCUMENTS

| | | | | |
|---|---|---|---|---|
| GB | 159299 | * | 2/1921 | 5/710 |

* cited by examiner

*Primary Examiner*—Lynne H. Browne
*Assistant Examiner*—James M Hewitt
(74) *Attorney, Agent, or Firm*—Brown Raysman Millstein Felder & Steiner LLP

(57) ABSTRACT

The present invention is directed to an alternating pressure pad comprising at least two sets of inflatable cells, each set being alternately inflated and deflated, wherein at least one cell in each cell set has further means, such as, for example, circumferential internal membranes or external straps, to accelerate the deflation of the at least one cell.

10 Claims, 5 Drawing Sheets

ALTERNATING PAD

This invention relates to alternating pressure pads, and in particular to alternating pressure pads of the kind used in the prevention and management of decubitous ulcers in bedridden patients.

The formation of decubitous ulcers, commonly known as bed sores, results from, amongst other things, the pressure applied to certain portions of the skin of a bedridden patient. In addition, it is well known that should the lower reflex arc be broken by, for instance, lesion of the spinal cord or of nerve roots then decubitous ulcers of unusual severity and rapidity of onset are likely to develop. It is known to meet the requirement for the prevention and management of decubitous ulcers with an alternately pressure pad comprising two sets of alternately cells: the duration of the inflation and deflation cycles may last from under two minutes for a gently massaging effect to over twenty minutes.

A low cell internal air pressure is desirable since it provides a pad which is softer and more comfortable. However, a high cell internal air pressure in the pads is generally needed to support the bony protuberances of a patient and to ensure that the patient is lifted sufficiently away from deflated cells of the pad so that adequate pressure relief is provided for parts of the body over these areas. At the high cell internal air pressure the heel portions of a patient reach an uncomfortably high pressure at their contact points with the pad surface and are known to develop sores.

Subsequent deflation to a lower cell internal pressure still maintains a high contact pressure at the heel portions.

It is known to provide means whereby the legs of a patient are supported such that their heel portions do not contact the pad surface at all. However, in such cases, the foot develops 'foot drop' due to lack of support of the foot at the heel. Other proposals have included providing a lower inflating pressure to the cells supporting the heel portions, but the problem of the local high contact pressure remains.

In accordance with the present invention, an alternating pressure pad comprises at least two sets of alternately inflatable cells, at least one cell comprising means to accelerate deflation of the cell subsequent to inflation. By providing accelerated deflation of the cell(s), the contact pressure at the surface of the cell is minimised, even reaching zero during a large part of the deflation cycle. The deflation of the cell is no longer reliant upon the weight of the body lying thereon and the rapid deflation of the cell from under the body part previously supported achieves very low contact pressure which in the support of heel portions is a major breakthrough in the avoidance of heel sores.

According to the invention, there is also provided an alternating pressure pad comprising at least two sets of alternately inflatable cells, at least one cell comprising means to further collapse the cell walls away from the pad surface during the deflation of the cell subsequent to inflation. This further collapse of the cell walls during deflation quickly removes the cell surface away from the body previously supported thereon and thereby provides a substantial period of time during deflation when there is very low contact pressure.

Preferably, the means may be applied externally or internally to the cell(s).

Preferably, the means comprises at least one member applying a force circumferentially to the cell when inflated. The member may be elastic or nonelastic and may be arranged internally or externally to the cell. Such a structure allows for conventional air supply systems to be used without the need for modifications, the applied force providing the accelerated deflation subsequent to inflation. Preferably, the means comprises an internal membrane arranged to restrict the shape of the cell when inflated, the membrane urging the cell to the collapsed state during deflation.

Preferably, the means comprises an inflating device having a greater rate of deflation than the rate of inflation.

Preferably, the alternately inflatable cells are inflated simultaneously.

According to another aspect of the invention there is provided a securement means for securing a pad onto a support including first and second attachment portions, the first attachment portion being connectable to a pad and the second attachment portion being connectable to a support supporting the pad and an energy absorption member connecting the first and second portions together.

The energy absorption member may be a loop of strip material secured to and extending in the longitudinal direction of the first and second portions. Alternatively, the energy absorption member may be a series of folds of strip material secured to and extending in the longitudinal direction of the first and second portions.

The portions may each be a strip of hook and pile material eg, Velcro.

Preferably the securement means includes a sheet securing device releasably secured to the first portion and more preferably secured such that its movement along the second portion is prevented. The sheet securing device is thus retained in place for attachment of sheets but can be easily removed in the event of repair or replacement.

Preferred embodiments of the present invention will now be described in detail by way of example only, with reference to the accompanying drawings of which:

Figure 5A:
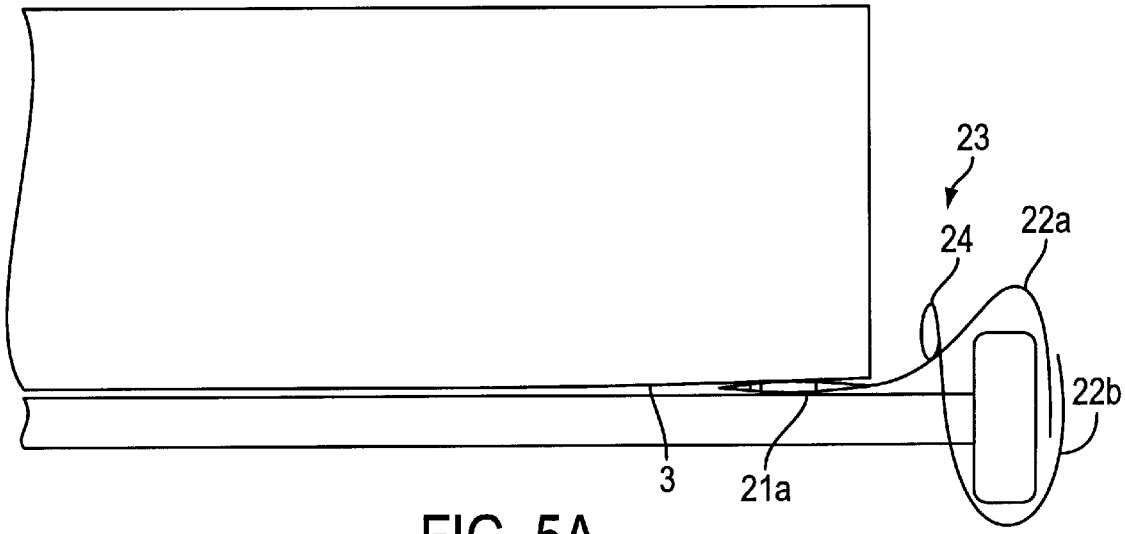
Figure 5B:
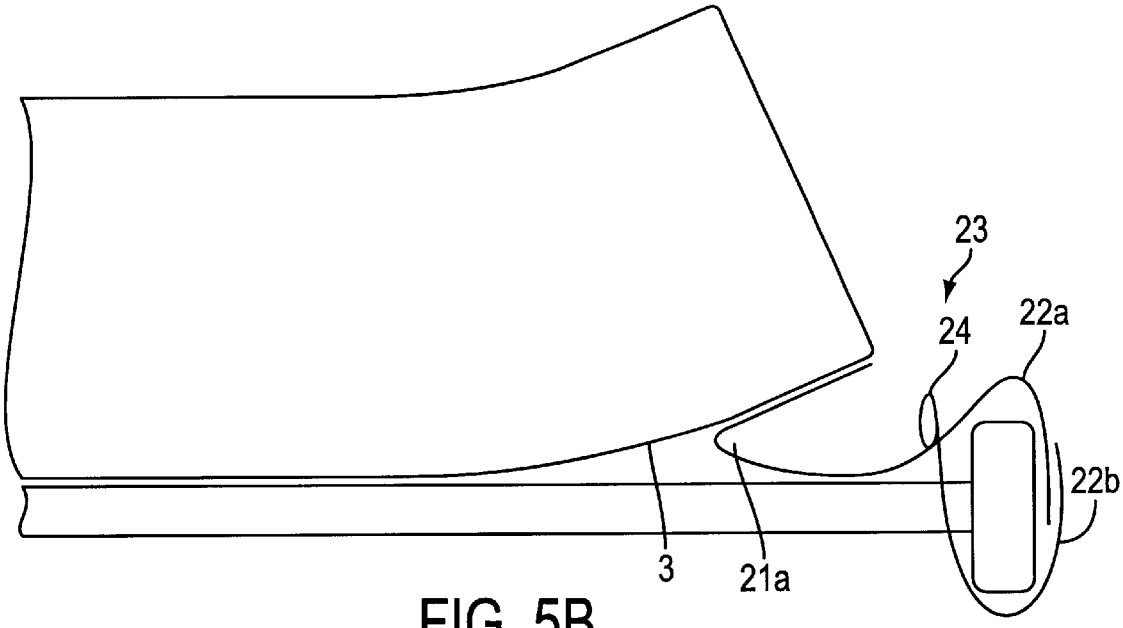
Figure 5C:
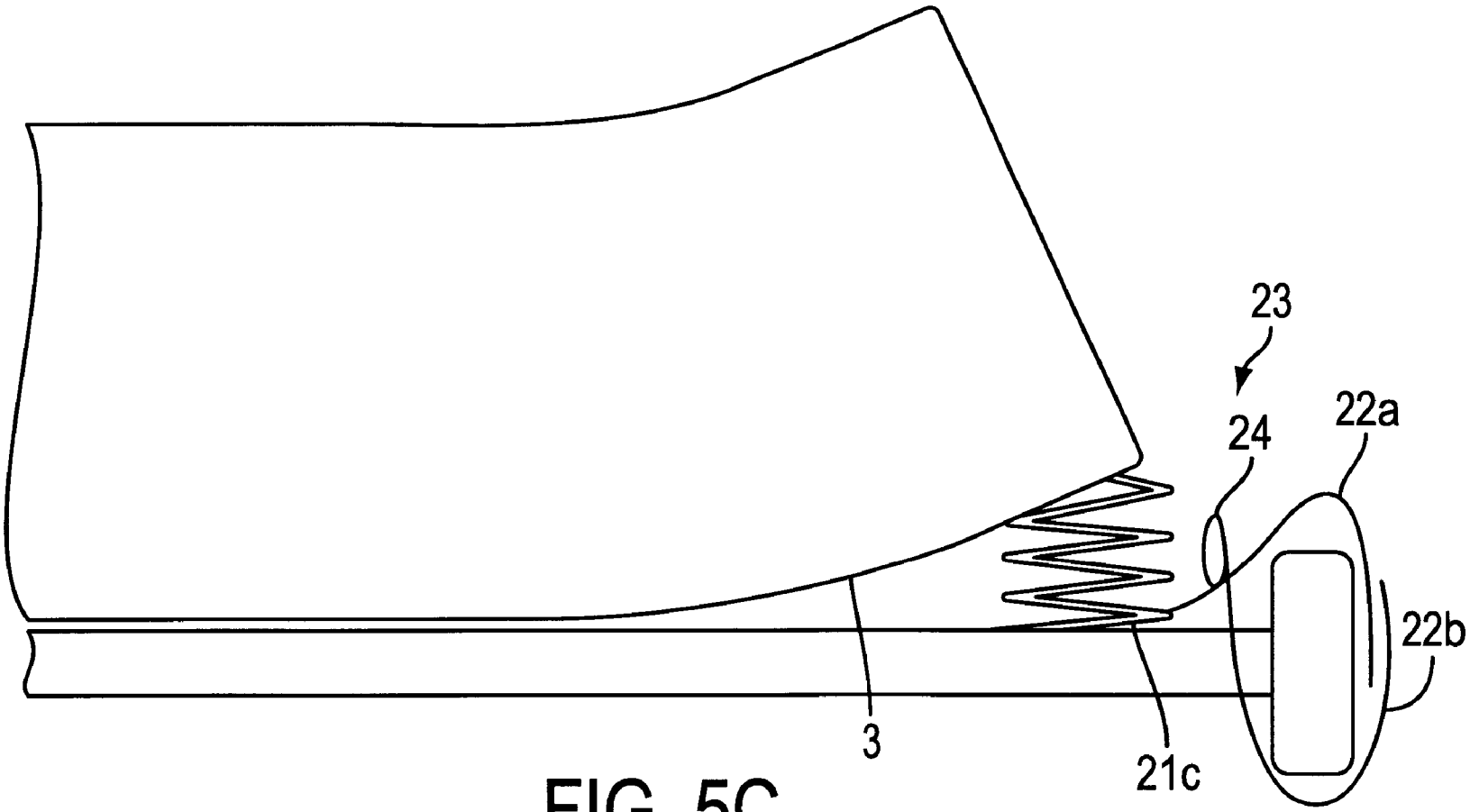

FIGS. 5*b* and 5*c* shows the securement means in operation.

Figure 6:
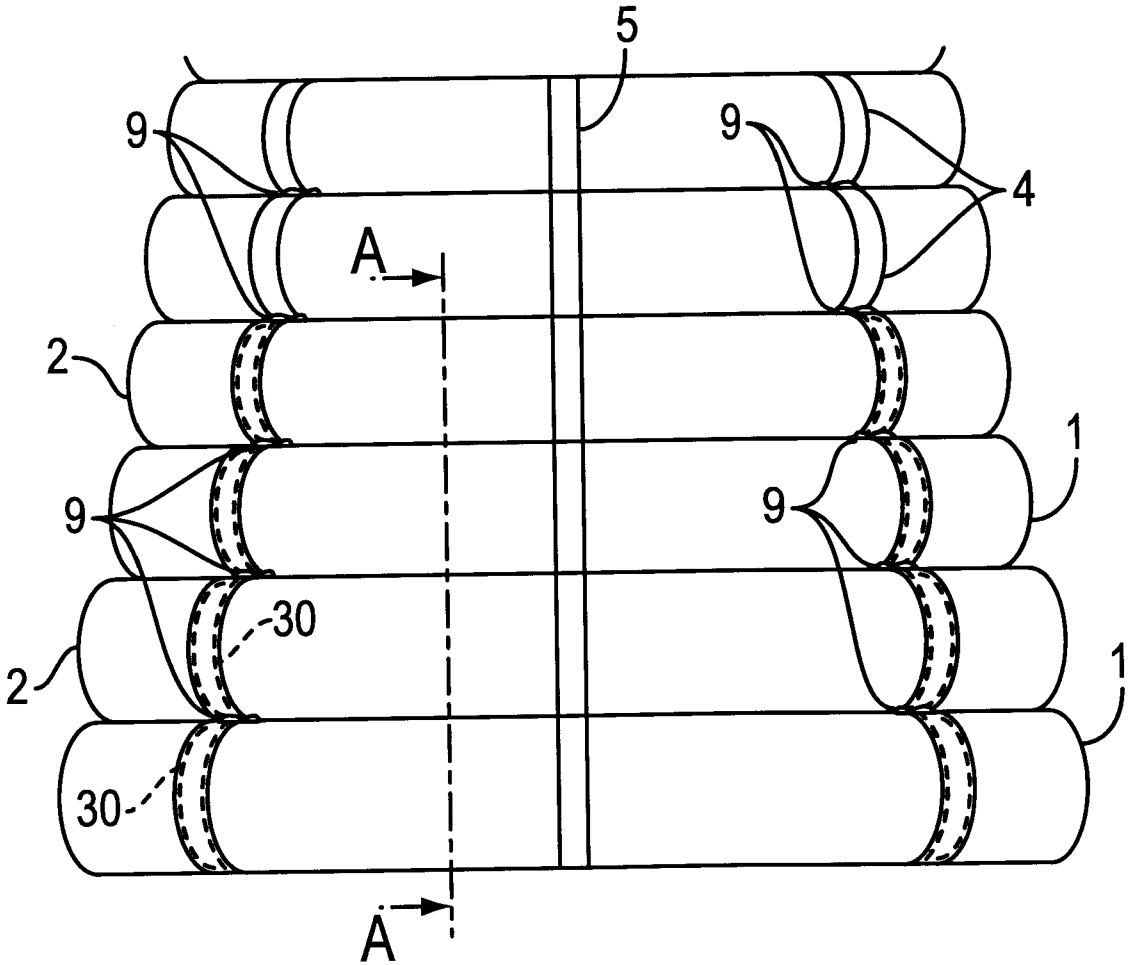

FIG. 6 is a schematic representation of an alternating pressure pad according to an alternative embodiment of the present invention.

Figure 1:
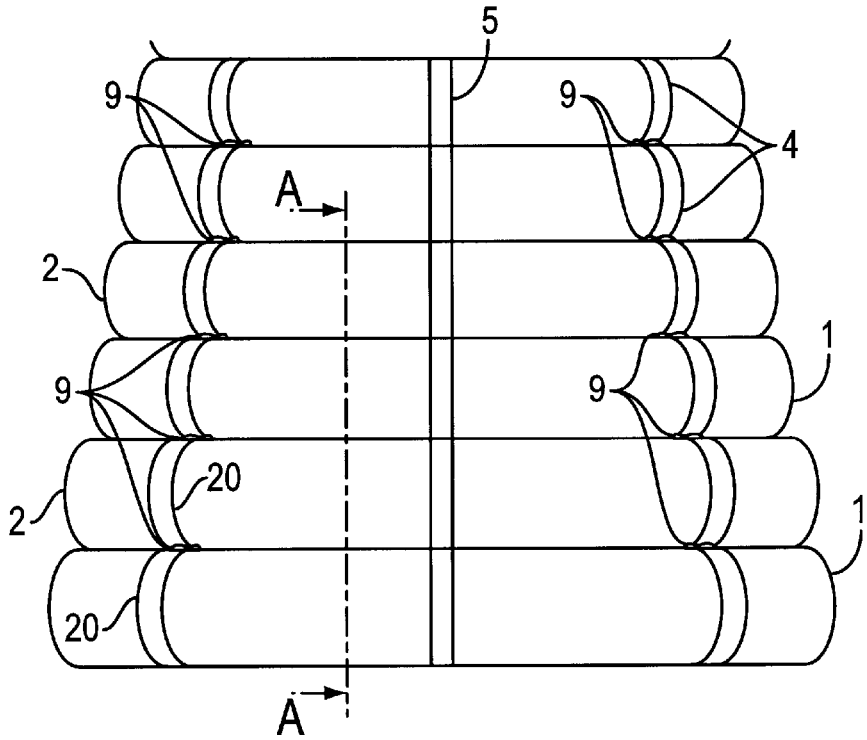
FIG. 1 is a schematic representation of an alternating pressure pad according to one embodiment of the present invention.

Referring to FIG. 1, a first set of inflatable cells 1 and a second set of inflatable cells 2 are shown, the first set being fully inflated and the second set fully deflated. The two sets are alternately inflatable and are supplied with air from a pump 5 feeding a rotary valve 11. The first and second sets are supplied air from respective feed lines 7 and 8.

There is a base sheet 3 of plastics material to which may be attached restraining loops 4 of plastics material, each cell being retained in position by at least one such loop 4. Adjacent loops are attached to one another by welds 9. In one embodiment, as shown in FIG. 1, at the foot end of the alternating pressure pad, the last four or five cells are restrained by elastic loops 20 instead of loops 4. On full inflation of the respective cells, the elastic loops 20 restraining the cells are stretched and exert a radial force locally across the circumference of the cells against the air inflating the cells. On subsequent deflation of these cells, the radial force exerted by the elastic loops 20 accelerates the release of air to atmosphere. The elastic loops 20 also provide a further effect of pushing the cells' surfaces inward and downward into a collapsed state during deflation.

Alternatively, the elastic loops 20 may be arranged to extend internally around the cell circumference. A similar result may also be achieved by replacing the elastic loops with inelastic loops but of smaller circumference than the cells.

Figure 2:
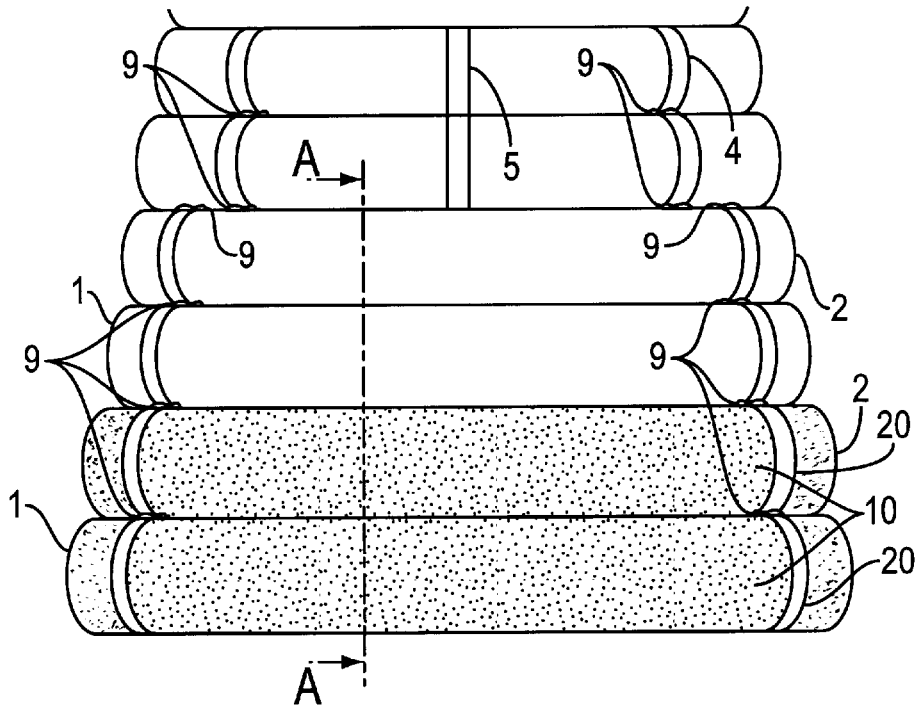
FIG. 2 is a schematic representation of another embodiment of the present invention.
Figure 3:
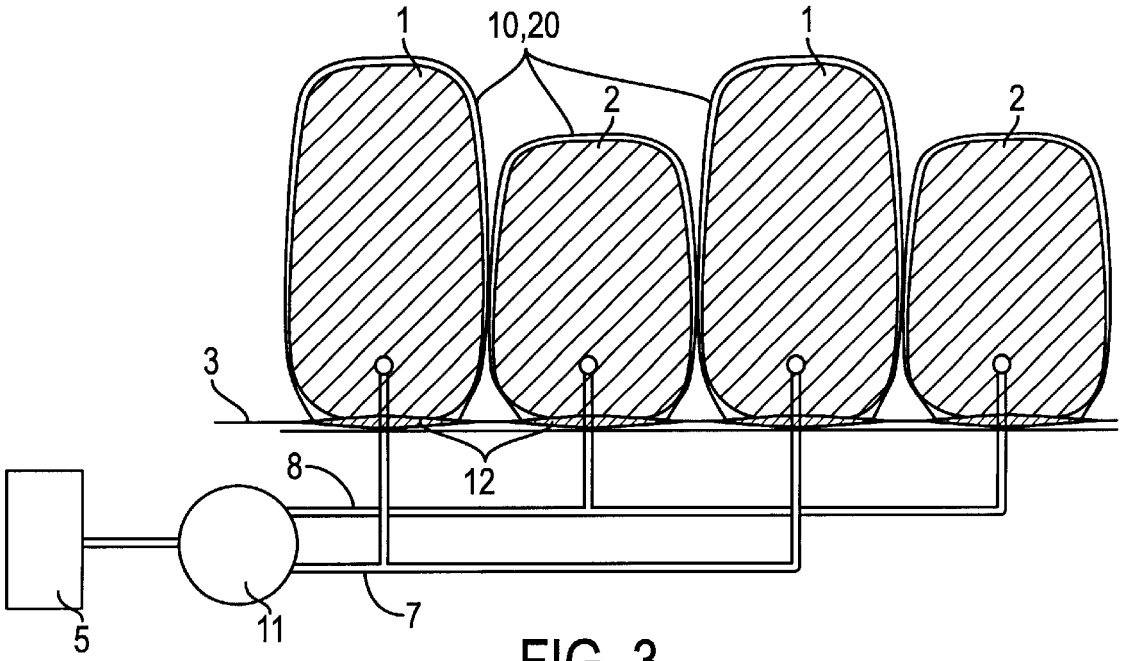
FIG. 3 is a schematic cross-sectional representation of the pads of FIGS. 1 and 2 along line A—A.

In another embodiment as shown in FIG. 2, the last three or four cells at the foot end of the pad are each retained in position by a sleeve 10 extending over each cell, the sleeve is held in place by loops 20 of elastic material. Each sleeve 10 extends over the length and circumference of the respective cell so that, on full inflation of the cell, the elastic loops 20 retaining the sleeve 10 are stretched and with the sleeve exert a radial force across the whole length of the cell against the air inflating the cell. On subsequent deflation of the cell, the radial force exerted by the sleeve accelerates the release of air to atmosphere. The sleeve also provides a further effect of pushing the cell surface inward and downward into a collapsed state during deflation.

We have found that rigid inserts 12 placed under the aforementioned cells provide improved downward pull of the cell walls by the elastic loops 20 or sleeve 10 during deflation thereby ensuring a rapid removal of the cell surface from under the supported body part. The accelerated deflation and/or the rapid removal of the cell surface ensures that the deflated cell supporting the heel portions does not contact the heel portions for a substantial period of time during the deflation cycle. During this period the heel portions are at zero contact pressure and maximum pressure relief.

In a further embodiment shown in FIG. 6 the cells may be provided with internal membranes of elastic material, the membranes being at full stretch on full inflation of the cell, and during deflation exerting an internal force urging the cell walls towards their deflated state and preferably also accelerating the rate of release of air to atmosphere.

The cells may be generally tubular and may be individually formed and restrained onto a base sheet to form the alternating pressure pad or the pressure pad may be made from top and bottom sheet material welded together to define alternately inflatable cells. The sets of cells are alternately supplied with fluid by the pump 4 via a conventional rotary valve 11. Instead of a rotary valve, conventional solenoids may be used to perform the same function.

Figure 4:
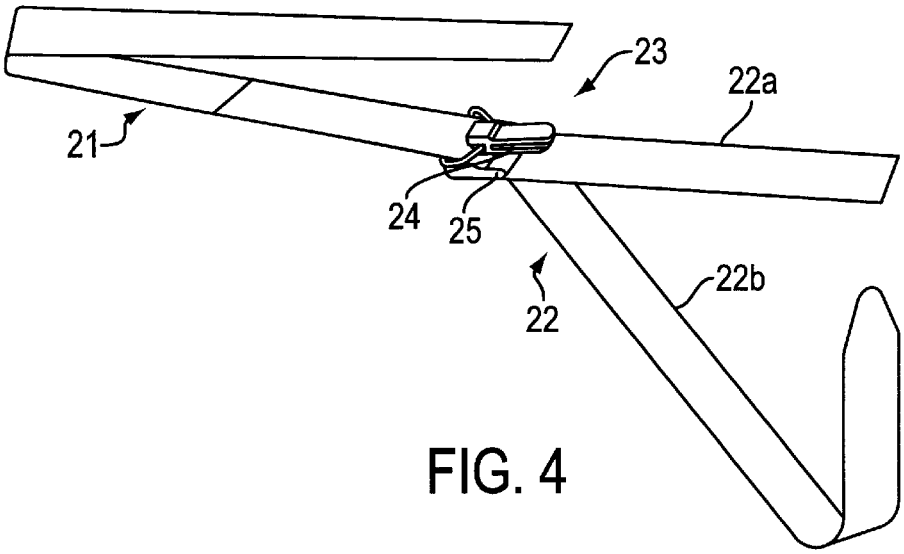
FIG. 4 is a schematic representation of a securing means according to the invention.

Additionally, as shown in FIGS. 4 and 5, the pad base sheet may include securing straps 20 to secure the pad and base sheet to a support base, for example, a bed base. The securing straps 38 consist of a first portion 21 attached to the pad base sheet and a second portion 22 connected to the first portion comprising two segments 22*a* and 22*b* which are arranged to secure together around a bed base part. The first and second portions may be of eg. Velcro material.

The first portion also includes an energy absorbing loop 21*a* before it joins with the second portion or alternatively, the loop 21*a* may be replaced by a series of folds 21*c* to perform the same function. With the energy absorption loop 21*a* or the folds all load applied to the pad and hence the base sheet via the straps 23 will initially "open" the loop/folds before reaching the strap and pad base sheet join, thereby reducing the incidences of tearing of the strap or pad base sheet at their join.

Each strap 23 is further provided with a sheet clip 24 at the first portion thereof to retain in place a sheet covering the pad. The clip 24 is releasably attached to the first portion 21 and is held in place by a detent 25 located at the join of the first 21 and second 22 portions. Pull of the clip 24 in the direction of securement of the sheets only further secures the clip 24 against the detent 25. However, the clip 24 can be removed easily sliding it along the first portion 21 to its end and replaced if required. Normally, in the event of sheet clips being damaged or broken, the whole of the pad base sheet or the associated straps had to be replaced.

It will be appreciated that all of the the embodiments described could easily be adapted for use in a segmented pressure pad arrangement so that the heel portions are supported without the risk of pressure sores.

It is envisaged that the present invention could be utilised not only in the medical field in the form of a pad or mattress but also in other fields where optimum support of the bony protruberances of a body is required.

What is claimed is:

1. An alternating pressure pad comprising:

at least two sets of alternately inflatable cells, at least one cell in each cell set comprising at least one force applying member wherein, during deflation of the cell subsequent to inflation, the force applying member accelerates said deflation; and securement means for securing the pad onto a support, the securement means comprising a first attachment portion and a second attachment portion, the first attachment portion being connectable to the pad and the second attachment portion being connectable to a support supporting the pad and an energy absorption member, the energy absorption member connecting the first and second attachment portions together.

2. The alternating pressure pad of claim 1 wherein the energy absorption member comprises a loop of strip material secured to, and extending in the longitudinal direction of, the first and second portions.

3. The alternating pad of claim 1 wherein the energy absorption member comprises a series of folds of strip material secured to, and extending in the longitudinal direction of, the first and second portions.

4. The alternating pressure pad of claim 1 comprising a sheet securing device releasably secured to the first attachment portion.

5. The alternating pressure pad of claim 4 wherein the sheet securing device is prevented from movement along the second portion.

6. An alternating pressure pad comprising:

at least two sets of alternately inflatable cells, at least one cell in each cell set comprising at least one force applying member wherein, during deflation of the cell subsequent to inflation thereof, the force applying member rapidly collapses cell walls into a deflated state; and securement means for securing the pad onto a support, the securement means comprising a first attachment portion and a second attachment portion, the first attachment portion being connectable to the pad and the second attachment portion being connectable to a support supporting the pad and an energy absorption member, the energy absorption member connecting the first and second portions together.

7. The alternating pressure pad of claim 6 wherein the energy absorption member comprises a loop of strip material secured to, and extending in the longitudinal direction of, the first and second portions.

8. The alternating pad of claim 6 wherein the energy absorption member comprises a series of folds of strip material secured to, and extending in the longitudinal direction of, the first and second portions.

9. The alternating pressure pad of claim 6 comprising a sheet securing device releasably secured to the first portion.

10. The alternating pressure pad of claim 9 wherein the sheet securing device is prevented from movement along the second portion.

* * * * *

UNITED STATES PATENT AND TRADEMARK OFFICE

CERTIFICATE OF CORRECTION

PATENT NO. : 6,349,439
DATED : February 26, 2002
INVENTOR(S) : Cook et al.

It is certified that error appears in the above-identified patent and that said Letters Patent is hereby corrected as shown below:

Column 1,
Line 15, delete "alternately" and add -- alternating --.

Column 2,
Line 42, add -- 5a -- after "FIGS."; substitute -- show -- for "shows".

Signed and Sealed this

Twenty-first Day of May, 2002

*Attest:*

*Attesting Officer*

JAMES E. ROGAN
*Director of the United States Patent and Trademark Office*